United States Patent [19]

Whelan et al.

[11] Patent Number: 4,657,735

[45] Date of Patent: Apr. 14, 1987

[54] MO-HF-C ALLOY COMPOSITION

[75] Inventors: Edward P. Whelan, Ann Arbor, Mich.; Eric Kalns, Corvallis, Oreg.

[73] Assignee: AMAX Inc., Greenwich, Conn.

[21] Appl. No.: 782,784

[22] Filed: Oct. 2, 1985

[51] Int. Cl.[4] ..... C22C 27/04

[52] U.S. Cl. ..... 420/429; 148/407; 148/423

[58] Field of Search ..... 420/429; 148/407, 423, 148/11.5 F, 12.7 B

[56] References Cited

U.S. PATENT DOCUMENTS 3,169,860 2/1965 Semchysheu ..... 420/429

OTHER PUBLICATIONS

Metals Outlook, Materials Engineering, vol. 72, No. 1, Jul. 1970, p. 17.

W. D. Klopp et al., J. of Metals, Jun. 1971, pp. 27–38.

Walter R. Witzke, Metallurgical Trans. A. vol. 7A, Mar. 1976, pp. 443–451.

*Primary Examiner*—Melvyn J. Andrews

*Assistant Examiner*—Robert L. McDowell

*Attorney, Agent, or Firm*—Michael A. Ciomek; Eugene J. Kalil

[57] ABSTRACT

A molybdenum-hafnium-carbon alloy is provided consisting essentially by weight of about 0.6% to about 1% Hf, about 0.045% to about 0.08% C, and the balance essentially molybdenum, the alloy being characterized such that during casting of an ingot and hot forging of a billet thereof, it has a substantially less tendency to crack compared to alloys containing Hf in excess of about 1% by weight and carbon in excess of 0.08% by weight, without substantial diminution in strength properties of said alloy at elevated temperatures.

4 Claims, 1 Drawing Figure

ULTIMATE TENSILE STRENGTHS OF THREE MOLYBDENUM ALLOYS AND OF COMMERCIAL TZM AT ROOM TEMPERATURE AND AT ELEVATED TEMPERATURES

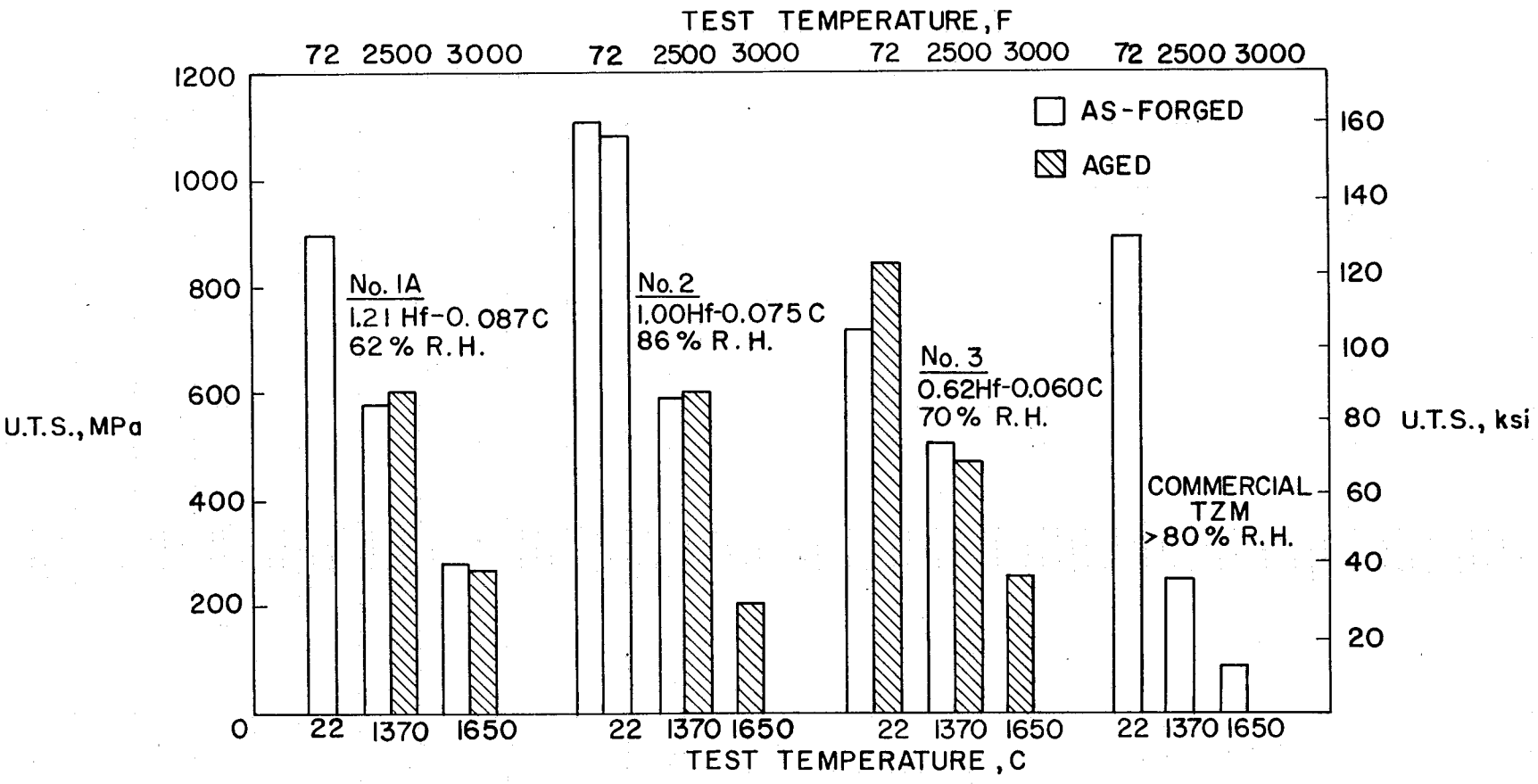
ULTIMATE TENSILE STRENGTHS OF THREE MOLYBDENUM ALLOYS AND OF COMMERCIAL TZM AT ROOM TEMPERATURE AND AT ELEVATED TEMPERATURES

MO-HF-C ALLOY COMPOSITION

This invention relates to an improved Mo-Hf-C composition suitable for the production of hot workable ingots.

STATE OF THE ART

Because of its high melting point, molybdenum is particularly attractive in the production of alloys for use as hot forging dies and advanced turbine discs for use in thermal engines. An alloy of interest is Mo-Hf-C, containing by weight about 1 to 1.3% Hf, about 0.09 to 0.13C and the balance molybdenum, because of its high strength properties at elevated temperatures. However, it is difficult to produce forgeable, substantially crack-free ingots of the aforementioned composition of diameters larger than 6 or 8 inches using standard vacuum arc melting practice.

On the other hand, large diameter substantially crack-free molybdenum-base ingots can be produced from a titanium-containing, zirconium-containing molybdenum alloy referred to in the trade by the designation TZM having the following approximate composition: 0.5% Ti, 0.10% Zr, 0.02% C and the balance molybdenum. However, the strength properties of this alloy are generally lower than the properties of the aforementioned Mo-Hf-C composition (MHC).

It would be desirable to provide a forgeable MHC alloy less sensitive to cracking during casting and having the desired high temperature strength properties.

An MHC alloy has now been developed with lower Hf and C levels which is less sensitive to cracking while retaining substantially the high temperature strength properties of the alloy with the higher Hf and C levels.

OBJECTS OF THE INVENTION

It is an object of the invention to provide an MHC alloy with lower amounts of Hf and C and which is less sensitive to cracking in both the cast and the forged states.

Another object is to provide a hot worked billet of an MHC alloy characterized by optimum strength properties at elevated temperatures.

These and other objects will more clearly appear from the following disclosure, the appended claims and the accompanying drawing.

STATEMENT OF THE INVENTION

Stating it broadly, the invention is directed to a molybdenum-hafnium-carbon alloy consisting essentially by weight of about 0.6% to about 1% Hf, about 0.045% to about 0.08% C, and the balance essentially molybdenum, the amount of Hf and C present being substantially such that the alloy, during casting of an ingot and hot forging of a billet thereof, has a substantially less tendency to crack compared to alloys containing Hf in excess of about 1% by weight and carbon in excess of 0.08% by weight.

A preferred composition is one containing essentially about 0.7% to 0.9% Hf, about 0.05% to 0.07% C and the balance essentially molybdenum.

It has been found that the susceptibility of MHC alloys to ingot cracking can be substantially reduced and the extrudability thereof improved by lowering both the hafnium and carbon contents to amounts not exceeding about 1% Hf and about 0.08% C without substantial diminution in the high temperature strength properties of the alloy following solution treatment and hot working of the alloy.

For optimum results, it is preferred that the Hf and C contents of the alloy be substantially stoichiometric with respect to HfC and within about ±15% of stoichiometry.

Compensation for potential reductions in strength and recrystallization properties due to lower carbon content is achieved by modifying the thermomechanical processing schedules. Tests have shown that several MHC alloys containing about 0.6 to 1% hafnium and from about 0.06 to 0.08% carbon and subjected to thermomechanical processing such as hot forging or hot extrusion, do not suffer a substantial loss in room- and elevated-temperatures of tensile properties compared to the properties of an alloy containing 1.2% Hf and 0.1% C.

BRIEF DESCRIPTION OF THE DRAWING

The FIGURE shows a comparison of the ultimate tensile strength as a function of test temperature for three Mo-Hf-C alloys and commercial alloy TZM.

DETAILS OF THE INVENTION

In carrying out the invention, tests were conducted on three alloy compositions, one of which was outside the composition of the invention. Three ingots were produced having the following dimensions: 102 mm (4 in.) in diameter by 380 mm (15 in.) long. The compositions of each of the ingots were as follows:

| Heat No. | Wt. % Hf | Wt. % C | Oxygen | Hardness HV10 |
|---|---|---|---|---|
| 1A | 1.21 | 0.087 | 8 ppm | 238 |
| 2 | 1.00 | 0.075 | 12 ppm | 208 |
| 3 | 0.62 | 0.060 | 14 ppm | 207 |

As will be noted, Heat 1A had a substantial higher hardness compared to Heats 2 and 3 because of the relatively high hafnium and carbon contents. The ingots were turned to 92 mm (3.62 in.) diameter and faced to sound stock. Two extrusion billets and a transverse slice were cut from each ingot. The extrusion billets were 92 mm (3.62 in.) in diameter by 165 mm (6.5 in.) long, and contained a 13 mm (0.5 in.) radius on the end nearest to the original bottom of the ingot. The transverse slice was cut from a location between the two extrusion billets at approximately the mid-length location of the ingots. Both faces of the slice were machined and the resulting chips were used for hafnium and carbon analyses. The transverse slice was cut in half and one of the halves was polished, macroetched and photographed. The remaining half-slice was used for preparation of samples for oxygen analysis and metallography.

EXTRUSION

The six extrusion billets machined from the three ingots were extruded from a 95 mm (3.75 in.) diameter extrusion container to 57 mm (2.25 in.) diameter bar stock with an extrusion ratio of 2.8:1, resulting in a cross-sectional reduction in area of 64%. One billet from each of the three ingots was extruded at 1700° C. (3090° F.) and the other at 1300° C. (2370° F.). The extrusion procedure consisted basically of heating each billet in a hydrogen-atmosphere furnace for one hour, removing it from the furnace and dipping in a glass lubricating powder, and then dropping it into the container of the extrusion press, followed by a carbon block which had been preheated to the extrusion temperature, and a steel dummy block. The press ram was then lowered and the billet was extruded through a zirconia-coated conical die into a round bar. The extruded bars were cooled to room temperature in air.

The extruded bars were grit-blasted and examined to determine the effects of extrusion temperatures and compositions. All extruded bars displayed some nose bursts, but in bars extruded at 1300° C. (2370° F.) the nose bursts were more severe than in bars extruded at 1700° C. (3090° F.). Comparison between bars extruded at the same temperatures, either at 1300° C. (2370° F.) or at 1700° C. (3090° F.), indicated that the nose bursts were more severe in bars prepared from Heat 3, the lower alloy heat, than in those prepared from heat 1A. The severity of nose bursts in bars prepared from Heat 2 occupied an intermediate position between Heats 1A and 3. In no instances were the nose bursts considered to be excessive. The general surface conditions of the extruded bars were acceptable and could not be correlated with either the extrusion temperatures or the compositions of the alloys.

FORGING

The extruded bars were cropped to sound stock and then sampled. A 114 mm (4.5 in.) long section was cut from each of the six extruded bars and was solution-treated for one hour at 2200° C. (3990° F.) in vacuum. The solution-treated sections were sampled and then machined into forging billets by turning the sections to remove surface imperfections and a decarburized layer, and by facing them to obtain an aspect (height:diameter) ratio of approximately 2:1. The billets were then upset hammer-forged at 1200° C. (2190° F.) into discs.

The upset hammer-forging was done at a commercial forging shop. One forging billet (1A″) displayed cracks after the solution heat treatment and was not forged; another billet (2″) may have been cracked prior to forging, and forging of this billet was stopped because of gross cracking after a reduction in height of only 50%. Forging of several other billets had to be stopped prematurely because of cracking problems, and only one of the billets (2″) received the intended reduction in height of at least 85%. (However, subsequent forging operations on this group of alloys, performed at a different forging shop, were conducted without the occurrence of any cracking). Forged discs 1A″, 2″ and 3″ were sufficiently large for preparation of tensile test specimens for use in the present investigation. In addition, samples from the three forgings were used for aging studies and for determination of recrystallization characteristics. Recrystallization properties of the three alloys are given in Table 1.

In processing schedules employed at the laboratory and at commercial forging shops engaged in producing molybdenum-base alloy forgings, extrusion is usually used for primary working, followed by upset hammer-forging. The size (diameter) of the extrusion is predetermined by the final forging size and the amount of forging deformation (reduction in height) required for metallurgical properties. The aspect ratio (height to diameter ratio) for a forging billet should not exceed 2:1 because of safety considerations. Thus, to obtain sufficiently large forgings with 85% R.H. for preparation of all the test specimens (tensile test specimens, aging samples and recrystallization samples), the extruded bars were approximately 57 mm (2.25 in.) in diameter. With the available laboratory press and its tooling, the 57 mm (2.25 in.) diameter bars translated to a low extrusion ratio of 2.8:1. While it was known that vacuum-arc-cast molybdenum-base alloys extruded at low extrusion ratios tended to crack at their nose ends, the extend of cracking for the alloys evaluated could not be predicted with any degree of accuracy. A low extrusion ratio was useful in that it minimized the possibility of stalling the press. As described earlier, all extruded bars displayed nose bursts. Nose bursts were severe in the bars extruded at the lower temperature 1300° C. (2370° F.). Also, for bars extruded at the same temperature, the severity of nose cracking appeared to be related to the ingot grain size: nose bursts in bars from low-carbon, larger-grained Heat 3″ were more severe than in the bars extruded from high-carbon, smaller-grained Heat 1A″. However, the nose-burst problem is easily minimized, and material recoveries increased, by increasing the extrusion ratio.

The forging experiments at a commercial forging shop indicate that serious cracking problems were encountered during forging, which is believed were related to the forging practice used by the commercial shop. Forging of the smaller billets at the laboratory was carried out without any problems. Subsequently, commercial forging were performed successfully.

The recrystallization properties of the three alloys 1A″, 2″ and 3″ are given in Table 1.

TABLE 1

Recrystallization Characteristics of Three MHC Alloys

| Heat No. and Compos. | Hammer Forging RH, % | Specimen Condition Prior To Recryst. Treatment | 1 Hour Annealing Temperature, C. (F.) | HV10 | Recryst., % |
|---|---|---|---|---|---|
| 1A″ | 62 | As-forged | Not annealed | 331 | 0 |
| 1.21Hf—0.087C | 62 | As-forged | 1400 (2550) | 385 | 0 |
| 1.21Hf—0.087C | 62 | As-forged | 1500 (2730) | 349 | 1 N[1] |
| 1.21Hf—0.087C | 62 | As-forged | 1600 (2910) | 333 | 3 N |
| 1.21Hf—0.087C | 62 | As-forged | 1700 (3090) | 315 | 10 |
| 1.21Hf—0.087C | 62 | As-forged | 1800 (3270) | 215 | 85 |
| 1.21Hf—0.087C | 62 | Forged + aged for 1 h at 1300° C. (2370° F.) | Not annealed | 401 | 0 |
| 1.21Hf—0.087C | 62 | Forged + aged for 1 h at 1300° C. (2370° F.) | 1400 (2550) | 352 | 0 |
| 1.21Hf—0.087C | 62 | Forged + aged for 1 h at 1300° C. (2370° F.) | 1500 (2730) | 346 | 1 N |
| 1.21Hf—0.087C | 62 | Forged + aged for 1 h at 1300° C. (2370° F.) | 1600 (2910) | 333 | 3 N |
| 1.21Hf—0.087C | 62 | Forged +, aged for 1 h at 1300° C. (2370° F.) | 1700 (3090) | 304 | 5 N |
| 1.21Hf—0.087C | 62 | Forged + aged for 1 h at 1300° C. (2370° F.) | 1800 (3270) | 209 | 95 |

TABLE 1-continued

| Heat No. and Compos. | Hammer Forging RH, % | Specimen Condition Prior To Recryst. Treatment | 1 Hour Annealing Temperature, C. (F.) | HV10 | Recryst., % |
|---|---|---|---|---|---|
| Recrystallization Characteristics of Three MHC Alloys | | | | | |
| 2" | 86 | As-forged | Not annealed | 366 | 0 |
| 1.00Hf—0.075C | 86 | As-forged | 1400 (2550) | 391 | 0 |
| 1.00Hf—0.075C | 86 | As-forged | 1500 (2730) | 357 | 10 |
| 1.00Hf—0.075C | 86 | As-forged | 1600 (2910) | 293 | 20 |
| 1.00Hf—0.075C | 86 | As-forged | 1700 (3090) | 252 | 50 |
| 1.00Hf—0.075C | 86 | As-forged | 1800 (3270) | 210 | 100 |
| 1.00Hf—0.075C | 86 | Forged + aged for 1 h at 1300° C. (2370° F.) | Not annealed | 425 | 0 |
| 1.00Hf—0.075C | 86 | Forged + aged for 1 h at 1300° C. (2370° F.) | 1400 (2550) | 361 | 0 |
| 1.00Hf—0.075C | 86 | Forged + aged for 1 h at 1300° C. (2370° F.) | 1500 (2730) | 337 | 15 |
| 1.00Hf—0.075C | 86 | Forged + aged for 1 h at 1300° C. (2370° F.) | 1600 (2910) | 297 | 20 |
| 1.00Hf—0.075C | 86 | Forged + aged for 1 h at 1300° C. (2370° F.) | 1700 (3090) | 237 | 75 |
| 1.00Hf—0.075C | 86 | Forged + aged for 1 h at 1300° C. (2370° F.) | 1800 (3270) | 209 | 100 |
| 3" | 70 | As-forged | Not annealed | 333 | 0 |
| 0.62Hf—0.060C | 70 | As-forged | 1400 (2550) | 357 | 0 |
| 0.62Hf—0.060C | 70 | As-forged | 1500 (2730) | 343 | 5 |
| 0.62Hf—0.060C | 70 | As-forged | 1600 (2910) | 293 | 25 |
| 0.62Hf—0.060C | 70 | As-forged | 1700 (3090) | 235 | 80 |
| 0.62Hf—0.060C | 70 | As-forged | 1800 (3270) | 198 | 100 |
| 0.62Hf—0.060C | 70 | Forged + aged for 1 h at 1300° C. (2370° F.) | Not annealed | 342 | 0 |
| 0.62Hf—0.060C | 70 | Forged + aged for 1 h at 1300° C. (2370° F.) | 1400 (2550) | 351 | 1 |
| 0.62Hf—0.060C | 70 | Forged + aged for 1 h at 1300° C. (2370° F.) | 1500 (2730) | 325 | 10 |
| 0.62Hf—0.060C | 70 | Forged + aged for 1 h at 1300° C. (2370° F.) | 1600 (2910) | 297 | 20 |
| 0.62Hf—0.060C | 70 | Forged + aged for 1 h at 1300° C. (2370° F.) | 1700 (3090) | 233 | 80 |
| 0.62Hf—0.060C | 70 | Forged + aged for 1 h at 1300° C. (2370° F.) | 1800 (3270) | 201 | 100 |

[1]Necklace-type recrystallization only.

Referring to Table 1, it will be noted that Heat 2" (1% Hf and 0.075% C), a preferred composition, was capable of being hammer-forged to a disc at a % R.H. (reduction in height) of 86%. The amount of carbon in the aforementioned composition was 11.9% in excess of the stoichiometric amount and within the preferred range of ±15% stoichiometry.

The high hafnium and high carbon Heat 1A" (1.21% Hf and 0.087% C) outside the invention had a much lower % R.H. of 62%.

With respect to the lower hafnium and low carbon Heat 3" (0.62% Hf and 0.060% C), the % R.H. after forging was substantially higher (70%) than that for Heat 1A" but not as high as that for the preferred Heat 2".

All alloys showed substantially complete recrystallization at 1800° C.

AGING STUDIES

The aging studies included the three discs mentioned in Table 1 and a number of samples both from the cracked forged discs and from the solution-treated extruded bar sections that were sufficiently small to be hammer-forged at the laboratory. Attempts were made to determine the relationships between compositions, extent of deformation and aging response, including the effects of double hammer-forging and double aging. The dependent variables used for evaluation of effects of aging were hardness and tensile properties for forged discs 1A", 2", and 3". For all other materials, room-temperature hardness was the standard evaluation.

TENSILE TESTING

Blanks for tensile test specimens were cut from the discs forged billets 1A", 2" and 3" in a radial orientation, with the mid-length point of blanks coinciding approximately with the mid-radius locus of the discs. Three tensile test specimens from each forged disc were machined from blanks in the as-forged condition; three additional blanks per forging were first aged at 1300° C. (2370° F.) for one hour and then machined into tensile test specimens.

Tensile test specimens had an overall length of 51 mm (2.0 in.) that included a 4.8 mm (0.187 in.) diameter by 19 mm (0.75 in.) long reduced section. Tensile tests were performed at room temperature, at 1370° C. (2500° F.) and at 1650° C. (3000° F.). The elevated temperature tests were performed in vacuum using strain rates of 0.005 $min^{-1}$ and 0.050 $min^{-1}$ in the elastic and plastic strain ranges, respectively. Tensile test results are compiled in Table 2. Ultimate tensile strength values as functions of test temperatures are plotted in the FIGURE. Included in the FIGURE are the strength values of commercial vacuum-arc-cast TZM to provide comparison with the Mo-Hf-C alloys.

The original intention was to hammer forge all the alloys to a 85% reduction in height. Such reduction was achieved with only Heat 2". Because of this situation, the room temperature strength values for forgings 1A" and 3" may be lower than those that could be attained with higher reductions. The strength values given in the FIGURE for TZM are applicable both to the bar stock and to upset forgings.

It is clear from the accompanying FIGURE that a considerable degree of high temperature strength persists in forging 3" despite its lower hafnium and carbon contents when compared with forging 1A". It is believed that higher tensile strength could be developed in forging 3" at 1370° C. (2500° F.), approaching that of the other two forgings, using forging reductions greater than 70%. Forging 3" is markedly superior to commercial TZM in terms of high temperature tensile strength, even though the stoichiometric relationship of Hf and C with respect to HfC is approximately 43%. As stated hereinbefore, it is preferred that the stoichiometry of Hf and C with respect to HfC be within about ±15%, since such alloys are more easily forgeable and form less cracks.

Referring again to the FIGURE, it will be noted that Heat 2" (1% Hf and 0.075% C) is within about ±15% stoichiometry and is comparable in physical properties to Heat 1A", while exhibiting good forgeability, the % R.H. (reduction in height) being 86% as compared to 62% R.H. for Heat 1A". It will also be noted that while Heat 3" is outside the preferred range of stoichiometry for HfC, it nevertheless exhibited forgeability compared to Heat 1A", as well as comparable physical properties.

In the as-forged condition, all three alloys were superior in strength to the TZM alloy at 1370° C. a shown in the FIGURE.

The physical properties of the three alloys tested are given in Table 2. Alloy 2" is comparable in tensile strength to Alloy 1A" following aging at 1300° C. for one hour and tensile testing at 1370° C.

Alloy 3" was comparable to the two aforementioned alloys when age hardened at 1300° C. for one hour and tensile tested at a higher temperature of 1650° C. Thus, Alloy 3" also represents an attractive alloy along with Alloy 2". Aging of the forged alloys produced substantially increases in hardness. Data on Alloy 3" are also listed in Table 2.

TABLE 2

Tensile Test Results

| Test Specimen: Billet Number; Analysis, Red. in height, % | Structural Condition | Test Temperature, C. | (F.) | Test Results: U.T.S., MPa | (ksi) | 0.2% Y.S., MPa | (ksi) | El., % | R.A., % |
|---|---|---|---|---|---|---|---|---|---|
| 1A" | As-forged | 22 | (72) | 901 | (130.7) | N.D.[1] | N.D. | N.D. | N.D. |
| 1.21Hf—0.087C | As-forged | 1370 | (2500) | 576 | (83.6) | 569 | (82.6) | 2.0 | 1.8 |
| 62% R.H. | As-forged | 1650 | (3000) | 281 | (40.7) | 247 | (35.9) | 3.3 | 1.1 |
| | Aged at 1300° C. | 1370 | (2500) | 605 | (87.8) | 588 | (85.3) | 4.0 | 3.3 |
| | (2370° F.) for 1 hour | 1650 | (3000) | 274 | (39.8) | 256 | (37.2) | 2.0 | 1.4 |
| 2" | As forged | 22 | (72) | 1108[2] | (160.7) | 1061 | (154.4) | 2.0 | 2.2 |
| 1.00Hf—0.075C | As forged | 22 | (72) | 1082 | (156.9) | 1045 | (151.5) | N.D. | 0.7 |
| 86% R.H. | As-forged | 1370 | (2500) | 592 | (85.9) | 546 | (79.2) | 9.3 | 6.9 |
| | Aged at 1300° C. | 22 | (72) | 1073 | (155.6) | N.D. | (N.D.) | N.D. | N.D. |
| | (2370° F.) for 1 hour | 1370 | (2500) | 599 | (86.9) | 556 | (80.7) | 8.0 | 8.0 |
| | " | 1650 | (3000) | 203 | (29.5) | N.D. | (N.D.) | 24.0 | 22.5 |
| 3" | As-forged | 22 | (72) | 717 | (104.0) | N.D. | (N.D.) | N.D. | N.D. |
| 0.62Hf—0.060C | As-forged | 1370 | (2500) | 503 | (72.9) | 494 | (71.7) | 6.7 | 6.9 |
| 70% R.H. | Aged at 1300° C. | 22 | (72) | 843[2] | (122.3) | N.D. | (N.D.) | N.D. | |
| | | | | | | | N.D. | | |
| | (2370° F.) for 1 hour | 1370 | (2500) | 469 | (68.0) | 468 | (67.9) | 5.3 | 9.8 |
| | " | 1650 | (3000) | 258 | (37.4) | 251 | (36.4) | 2.7 | 5.8 |

[1]N.D. = not determined because values were too small for measurement (in case of elongation and reduction in area) or fracture occurred before 0.2% offset yield point was reached.
[2]Fracture outside gage length.

Thus, by subjecting the MHC alloys to thermomechanical processing, the hafnium and carbon content of the standard alloy (1 to 1.3% Hf and 0.09 to 0.13% C) can be substantially reduced without serious reduction in high temperature strength properties, while also decreasing cracking tendency of the alloy. The alloys with the reduced amounts of hafnium and carbon respond to aging treatments to a degree similar to that of the alloys with larger amounts of hafnium and carbon.

This has been confirmed by other tests on alloys of similar composition, including the TZM alloy as shown in Table 3 as follows:

| Alloy No. Composition | RH, % | Test Temperature, C. (F.) | Test Results: U.T.S., MPa (ksi) | 0.2% Y.S., MPa (ksi) | Elong., % | R.A., % |
|---|---|---|---|---|---|---|
| 4 | | | | | | |
| 0.60Hf—0.062C | 71 | 1200 (2190) | 569 (82.5) | 541 (78.5) | 3.5 | 26.6 |
| | | 1370 (2500) | 504 (73.1) | N.D. (N.D.)[a] | 3.5 | 5.4 |
| 5 | | | | | | |
| 0.84Hf—0.063C | 72 | 1200 (2190) | 658 (95.5) | 625 (90.6) | 10.0 | 49.1 |
| | | 1370 (2500) | 547 (79.3) | 506 (73.4) | 7.5 | 27.9 |
| 6 | | | | | | |
| 1.11Hf—0.064C | 74 | 1200 (2190) | 612 (88.7) | 583 (84.6) | 8.0 | 29.7 |
| | | 1370 (2500) | 487 (70.6) | 332 (48.2) | 3.5 | 4.3 |
| 7A | | | | | | |
| 1.22Hf—0.10C | 86 | 1205 (2200) | 676 (98.1) | 656 (95.1) | 9.9 | 32.0 |
| | | 1370 (2500) | 547 (79.4) | 487 (70.7) | 8.7 | 20.1 |
| 8A(TZM) | | | | | | |
| 0.55Ti—0.11Zr— | 80 | 1205 (2200) | 541 (78.5) | 518 (75.2) | 18.0 | 50.8 |

-continued

| Alloy No. Composition | RH, % | Test Temperature, C. (F.) | Test Results U.T.S., MPa (ksi) | 0.2% Y.S., MPa (ksi) | Elong., % | R.A., % |
|---|---|---|---|---|---|---|
| 0.027C | | | | | | |

[a]N.D. = not determined

Alloys 4, 5 and 6 fall within the composition range of the invention, Alloy 5 being preferred. The highest tensile properties at elevated temperature was obtained with Alloy 7A (1.22% Hf and 0.1% C). However, this alloy has greater tendency to crack compared to Alloys 4, 5 and 6 with the lower hafnium and carbon contents. The tensile properties of these alloys at about 1200° C. were superior to the commercial TZM alloy (8A).

Alloys 4, 5 and 6 were vacuum arc cast into 100 mm (4 in.) diameter ingots and were extruded at 1315° C. (2400° F.) with a ratio of 2.9:1 to rectangular bars 51×48 mm (2-1/16×1⅞ in.) in section. Billets from these bars were solution treated for 1 hour at 2200° C. (3990° F.) and then forged at 1230° C. (2250° F.) to approximately 70% reduction in height. The tensile properties of this forged material at 1200° C. (2190° F.) and 1370° C. (2500° F.) are presented in Table 3. Included in Table 3 are tensile data for a solution treated and forged alloy 7A and for a solution treated and forged TZM Alloy 8A. Alloy No. 5 with substantially stoichiometric Hf:C ratio, is superior to TZM at 1200° C. (2190° F.) and is equivalent to Alloy 7A at 1200°/1205° C. (2190°/2200° F.) and 1370° C. (2500° F.).

In summary, tests have shown that ingot cracking and extrudability of the high strength molybdenum-base alloys are related to the carbon or carbide content thereof. The lower the carbon content, the lower is the susceptibility to cracking and the lower is the required extrusion temperatures and loads. This is particularly true with low carbon compositions (i.e., carbon not exceeding about 0.08%, e.g. about 0.7% to 0.9% Hf and about 0.05% to 0.07% C) in which the amounts of Hf and C are substantially stoichiometric with respect to HfC and within about ±15% of stoichiometry.

The decrease in hafnium and carbon content and the attendant decrease in strength properties are compensated for by employing thermomechanical processing modifications to optimize the contribution of the available carbides. Thus, the alloy ingot after cleaning is first extruded to a bar or billet at an extrusion ratio of about 1.5:1 to 10:1, preferably from about 2.5:1 to 5:1 at a temperature ranging from 1200° C. to 1800° C., e.g. from about 1400° C. to 1800° C. using glass powder as a lubricant.

Following extrusion, the bars or billets are cleaned and cropped to the desired size. The billets are solution treated at a temperature ranging from about 1800° C. to 2300° C., e.g. from about 2100° C. to 2250° C. for a time at least sufficient to effect substantially complete solution of the carbides, the time ranging from about 0.5 hour to 5 hours, preferably from about 1 hour to 2 hours under inert conditions.

The billets are hot forged at a temperature of about 1100° C. to 1450° C., e.g. about 1150° C. to 1300° C. at a reduction of about 50% to 90%.

In the as-forged condition, the billet is aged at a temperature of about 1100° C. to 1500° C., e.g. about 1200° C. to 1400° C. for at least about 1 hour and generally ranging from about 1 hour to 5 hours.

Compared to the TZM alloy, the molybdenum-base alloy of the invention has a fairly high recrystallization temperature. Referring to Table 1, the alloys of the invention 2" and 3" (preferably 2") is substantially fully recrystallized at a temperature of about 1800° C. in one hour compared to 1540° C. for the TZM alloy (not shown).

The alloy of the invention is capable of being recrystallized at least about 50% at temperatures ranging from about 1650° C. to 1800° C., for example, from about 1675° C. to 1750° C.

Although the present invention has been described in conjunction with the preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A molybdenum-hafnium-carbon alloy consisting essentially by weight of about 0.6% to about 1% Hf, about 0.045% to about 0.08% C, and the balance essentially molybdenum, the amount of Hf and C present being controlled to within about ±15% of stoichiometry with respect to HfC, the alloy being characterized such that during casting of an ingot and hot forging of a billet thereof, it has a substantially less tendency to crack compared to alloys containing Hf in excess of about 1% by weight and carbon in excess of 0.08% by weight, without substantial diminution in strength properties of said alloy, and further being characterized by having, in the forged condition, a tensile strength at 1370° C. (2500° F.) of at least about 70.6 ksi.

2. The molybdenum-hafnium-carbon alloy of claim 1, wherein Hf ranges from about 0.7% to about 0.9% and C ranges from about 0.05% to about 0.07%.

3. As an article of manufacture, a cast ingot of a molybdenum-hafnium-carbon alloy consisting essentially by weight of about 0.6% to about 1% Hf, about 0.045% to about 0.08% C, and the balance essentially molybdenum, the amount of Hf and C present being substantially stoichiometric with respect to HfC and within about ±15% of stoichiometry, the ingot being characterized in that it has a substantially less tendency to crack compared to alloys containing Hf in excess of about 1% by weight and carbon in excess of 0.08% by weight, without substantial diminution in strength properties of said alloy.

4. The article of manufacture of claim 3, wherein Hf ranges from about 0.7% to about 0.9% and C ranges from about 0.05% to about 0.07%.

* * * * *